United States Patent [19]

Maki

[11] Patent Number: 4,884,753

[45] Date of Patent: Dec. 5, 1989

[54] PULVERIZING METHOD

[76] Inventor: Toshiya Maki, 725-1, Funaho, Funaho-cho, Asakuchi-gun, Okayama, Japan

[21] Appl. No.: 275,564

[22] Filed: Nov. 22, 1988

[51] Int. Cl.[4] ..... B02C 19/12; B02C 23/18

[52] U.S. Cl. ..... 241/3; 241/4; 241/15; 241/23; 241/28

[58] Field of Search ..... 241/3, 4, 15, 23, 30, 241/28, DIG. 17, DIG. 38

[56] References Cited

U.S. PATENT DOCUMENTS 2,075,023 3/1937 David ..... 241/28 X

*Primary Examiner*—Joseph M. Gorski

*Attorney, Agent, or Firm*—Wenderoth, Lind & Ponack

[57] ABSTRACT

A method for pulverizing a material comprises having the material packed into an ice tube and frozen to form a composite ice pillar. The pillar is ground from one end thereof on a grinder. The outer tube serves to prevent the material from being scattered prematurely before being sufficiently pulverized. This method assures pulverization to a fine powder, at one operation, and a low cost.

8 Claims, 2 Drawing Sheets

PULVERIZING METHOD

BACKGROUND OF THE INVENTION

The present invention relates to a method for pulverizing a fibrous material such as chaff, pulp and bamboo, or a plastic material.

There are various known pulverizing methods. Among them, the method of the present invention can be classified as a grinding method. With a typical prior art grinding method as shown in FIG. 5, the material to be pulverized is ground in a stone mill having a fixed lower stone 11 and a rotary upper stone 10. But with this method, since it is difficult to pulverize the material at one operation into powder having a particle size of less than 200 mesh, the material has to be repeatedly classified and ground. Further, with this prior art stone mill type grinder, it is known that about half the material is blown off unground the moment it touches the rotating grinder. Thus, such a conventional method is not only inefficient but also costly.

SUMMARY OF THE INVENTION

It is an object of the present invention to provide a method for pulverizing a material which obviates the above problems of the prior art.

In accordance with the present invention, there is provided a method for pulverizing a material comprising the steps of packing a material to be pulverized in a tube and grinding the tube together with the material packed therein from one end of the tube. The tube should be an ice tube made by freezing water or other liquid.

The material can be kept in contact with a rotating grindstone for a longer time, so that the material can be pulverized into sufficiently fine powder at one time without causing undue heat buildup due to friction between the material and the grinder.

According to the present invention, the tube is made of a material different from the material to be pulverized. It serves to confine the material therein during grinding and prevents it from being discharged too soon to be sufficiently pulverized.

The material to be pulverized is packed in a tube made of a sufficiently hard material which can be separated from the material to be pulverized after both materials have been pulverized, by any suitable method such as magnetic separation, gravity separation or separation by melting, condensing or centrifuging. The material may be metal, plastic or a frozen liquid.

The material to be pulverized may be packed in the tube as it is or may be soaked with a liquid and frozen after being packed in the tube. The tube stuffed with the material to be pulverized is brought into contact with the rotating grinder from one end. It has been found that the tube serves to prevent the material inside, especially the material near the outer periphery, from being blown off prematurely by contact with the grinder before it is sufficiently pulverized.

BRIEF DESCRIPTION OF THE DRAWINGS

Other features and objects of the present invention will become apparent from the following description taken with reference to the accompanying drawings, in which.

DESCRIPTION OF THE PREFERRED EMBODIMENT

Figure 1:
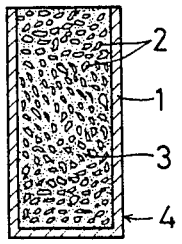
FIG. 1 is a sectional view of an outer tube filled with a frozen material to be pulverized.

Now referring to FIG. 1, a material 2 to be pulverized (such as chaff) is mixed with water, stuffed in an ice tube 1 (e.g. measuring 100 mm×80 mm×200 mm) and frozen into an ice pillar 4 made of frozen water 3 with the material 2 dispersed therein.

Figure 2:
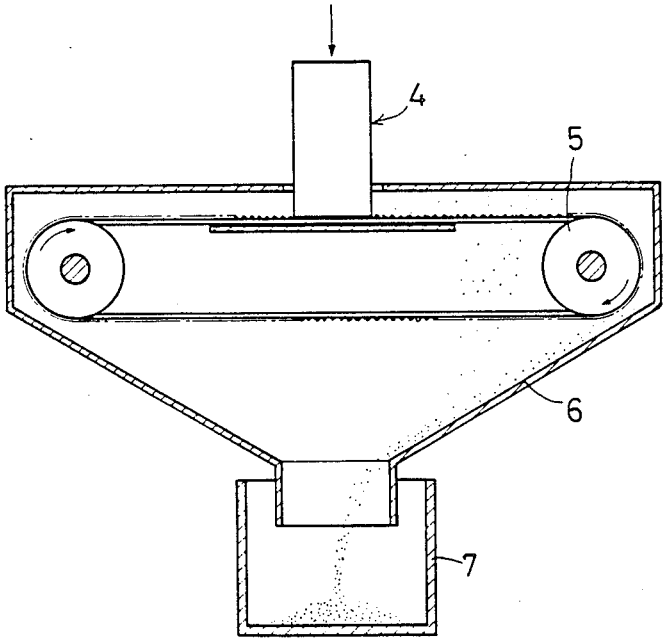
FIG. 2 is a schematic sectional view of a belt grinder showing how the outer tube stuffed with the material to be pulverized is ground.

As shown in FIG. 2, the ice pillar 4 is brought into contact under pressure with a belt grinder 5 from one end thereof so as to grind it into fine powder. The powder will be scattered against the inner wall of a grinder cover 6 and collected into a container 7 in a pasty state. The pasty substance thus collected is dehydrated and dried, leaving the material 2 which has been uniformly and finely pulverized.

Figure 3:
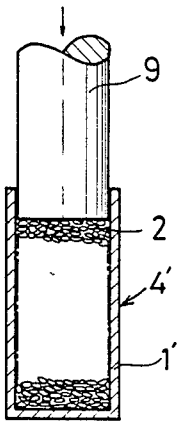
FIG. 3 is sectional view of the outer tube made of iron and filled with the frozen material to be pulverized.

As shown in FIG. 3, an outer tube 1' made of iron may be used instead of the ice tube 1 so that the material will be ground into powder together with the iron tube 1'. The iron powder mixed in the pulverized material 2 can be removed by means of a magnetic separator.

Figure 4:
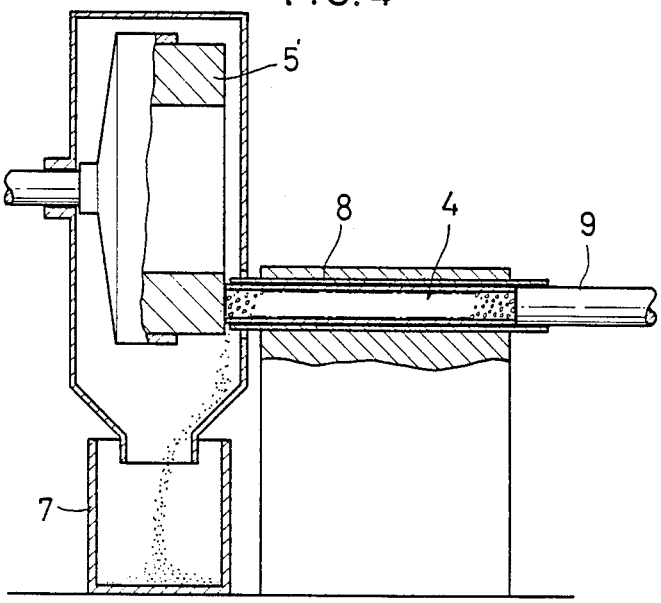
FIG. 4 is a schematic view of another type of grinding machine used in the method according to the present invention.
Figure 5:
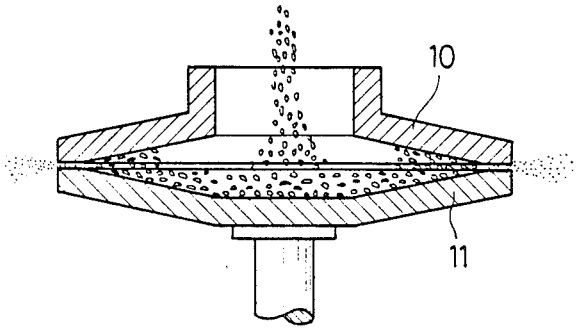
FIG. 5 is a sectional view showing a prior art method of pulverizing.

FIG. 4 shows another type of grinding machine 5' on which the ice tube 4 packed with the frozen material 2 to be pulverized is mounted in a fixed outer tube 8 made of iron or steel. Tube 4 is pushed out of the fixed outer tube 8 by means of a pushing rod 9 toward the grinder 5'. In this embodiment, the outer tube 8 is not ground together with the material to be pulverized.

According to the present invention, the outer tube may be ground into powder together with the material to be pulverized. The powdered outer tube mixed in the material to be pulverized may be removed therefrom after grinding.

The outer tube may also be made of a material which may be mixed or is desired to be mixed, with the material to be pulverized.

According to the present invention, the frictional heat generated between the grinder and the material to be pulverized is kept to a minimum if the outer tube is frozen, and thus the material can be pulverized without any fear of suffering any change of properties. Moreover, since the material can be pulverized into sufficiently fine powder at one operation, it is possible to improve the production efficiency while minimizing the production cost. The method of the present invention may be applied to pulverizing such material as foodstuffs, medicines, and plastic and rubber materials.

What is claimed is:

1. A method of pulverizing a material, said method comprising the steps of:

providing a tube made of liquid frozen into a tubular shape;

packing a material to be pulverized into said tube made of said liquid; and grinding said tube and said material to be pulverized packed therein by grinding from one end of said tube.

2. The method of pulverizing a material as set forth in claim 1, and further comprising the step of:

freezing said material to be pulverized together with a liquid in said tube after said step of packing and before said step of grinding.

3. The method of pulverizing a material as set forth in claim 1, wherein said step of grinding further comprises:

providing a grinder and a fixed outer pipe adjacent said grinder;

placing said tube with said material packed therein inside said fixed outer pipe; and pushing said tube out of saId fixed outer pipe and against said grinder.

4. A method of pulverizing a material, said method comprising the steps of:

providing a tube for receiving a material to be pulverized therein;

packing said material to be pulverized into said tube and freezing said material to be pulverized in said tube together with a liquid; and grinding said tube and said material to be pulverized packed and frozen therein by grinding from one end of said tube.

5. The method of pulverizing a material as set forth in claim 4, wherein said step of providing a tube comprise:

providing a tube made of metal.

6. The method of pulverizing a material as set forth in claim 4, wherein said step of providing a tube comprises:

providing a tube made of plastic.

7. The method of pulverizing a material as set forth in claim 4, wherein said step of providing a tube comprises:

providing a tube made of a frozen liquid.

8. The method of pulverizing a material as set forth in claim 4, wherein said step of grinding comprise:

providing a grinder and a fixed outer pipe adjacent said grinder;

placing said tube with said material packed therein inside said fixed outer pipe; and pushing said tube out of said fixed outer pipe against said grinder.

* * * * *